US006135632A

United States Patent [19]

Flint

[11] Patent Number: 6,135,632

[45] Date of Patent: Oct. 24, 2000

[54] DISPOSABLE STATIC MIXING DEVICE HAVING CHECK VALVE FLAPS

[76] Inventor: Theodore R. Flint, P.O. Box 50, Elverson, Pa. 19520

[21] Appl. No.: 09/334,353

[22] Filed: Jun. 16, 1999

[51] Int. Cl.[7] ..... B01F 5/06

[52] U.S. Cl. ..... 366/340; 366/336; 138/42

[58] Field of Search ..... 366/130, 189, 366/336, 337, 340; 138/42, 43; 206/219, 221; 215/DIG. 8; 383/38

[56] References Cited

U.S. PATENT DOCUMENTS

| | | | |
|---|---|---|---|
| 3,156,352 | 11/1964 | Hayhurst . | |
| 3,159,312 | 12/1964 | Van Sciver, II . | |
| 3,335,912 | 8/1967 | Reaves, Jr. . | |
| 3,394,924 | 7/1968 | Harder . | |
| 3,608,709 | 9/1971 | Pike . | |
| 3,927,868 | 12/1975 | Moore . | |
| 4,130,245 | 12/1978 | Bryson . | |
| 4,540,089 | 9/1985 | Maloney | 383/38 |
| 4,952,068 | 8/1990 | Flint . | |
| 5,154,321 | 10/1992 | Shomer | 206/219 |
| 5,492,219 | 2/1996 | Stupar | 206/219 |
| 5,516,209 | 5/1996 | Flint et al. | 366/340 |

FOREIGN PATENT DOCUMENTS

| | | | |
|---|---|---|---|
| 60-12890 | 4/1985 | Japan | 366/130 |

*Primary Examiner*—Charles E. Cooley
*Attorney, Agent, or Firm*—Duane, Morris & Heckscher LLP

[57] ABSTRACT

A static mixing dispenser provides a circuitous flowpath for plural components to be mixed between the inlet and the outlet of a conduit. Coextensive exterior sheets forming a tube can be attached to an interior sheet having openings communicating through the interior sheet. The sheets are sealed together at interior obstructions, forming mixing stages that subdivide and recombine the stream of material. The interior obstructions comprise sheets having openings formed through the thickness of each sheet. The openings each have a flap of sheet material, the partial detachment of which from the sheet forms the opening, leaving a connection of limited area around which the flap can pivot. The flap is thus bendable relative to the sheet so that the flap opens during the movement of flowable components in a first direction, and closes during movement of the flowable components in a second direction, forming an array of check valves that advance the material from the source to the outlet as the device is compressed manually or pressure is otherwise applied.

11 Claims, 4 Drawing Sheets

DISPOSABLE STATIC MIXING DEVICE HAVING CHECK VALVE FLAPS

BACKGROUND OF THE INVENTION

1. Field of the Invention

The invention relates to dispensing containers in which a dispensing flowpath is provided with a mixing structure for two or more initially-isolated components, such as a resin and a curing agent. More particularly, the invention provides an improved static mixing device for mixing plural flowable components by combining, subdividing and recombining streams of the composition, wherein the composition flows substantially exclusively in one direction along the flowpath from two or more source compartments to a discharge opening.

2. Prior Art

Static mixing devices for dispensing containers are generally known. These devices can include discharge conduits defined in part by fixed structures that partially obstruct a stream of material flowing generally through the device from a source to a discharge, so as to cause mixing. The obstructions guide the materials along a circuitous path with eddies and the like, and mix the multi-component composition more thoroughly than is possible where material streams from plural sources are carried along an unobstructed conduit. The mixing process is accomplished by continuously dividing and recombining the material stream (i.e., the two or more flowing components). In an unobstructed conduit such streams can flow side by side without substantial mixing. This is particularly true for relatively viscous materials.

The flow is driven generally by compressing the materials, e.g., in a flexible bag, to squeeze the material forward in the direction of flow. This can be done manually or with the aid of a roller or other compressing mechanism.

An example of a dispensing container with mixing structures as described is disclosed in U.S. Pat. No. 4,952,068—Flint, the disclosure of which is hereby incorporated. The Flint conduit is formed from opposing sheets of material defining a flexible multi-component squeeze container. Seams join the perimeters of opposing sheets to form a flexible container, with at least one internal wall dividing the container into at least two storage compartments for isolating the flowing components before they are brought together for use. At least one internal wall further downstream toward the outlet is provided for mixing. External pressure on the container bursts at least one isolating wall or seam and forces the plural components to combine. The materials combine in an initial mixing area along the flowpath in the container, downstream of the walls defining the storage compartments. Downstream dividing walls define the path from the initial mixing area to the container outlet. The walls divert the flow and cause the stream of flowing material to separate and recombine one or more times prior to exit from the container, which provides improved mixing as compared to a substantially laminar flow through an unobstructed conduit.

The material is squeezed along the flowpath by applying a peristaltic squeezing action to the flexible container. The obstructions and the squeezing action cause flow variations; however, not all of the resulting variations are beneficial for mixing. Depending on the care taken in squeezing and kneading the material along the flowpath in a forward direction, portions of the components can be forced to flow in a reverse direction, i.e., toward the storage compartments, as they separate and recombine in the sinuous path permitted by the obstructions. This is disadvantageous since these mixed components can move back toward the storage compartments and contaminate or change the relative concentrations of the as yet unmixed components.

U.S. Pat. No. 5,516,209—Flint, which is also incorporated herein, discloses a mixing dispenser in the form of a flexible mixing conduit with durable means attached to a source of plural flowable components, e.g., a multi-component sealant cartridge. The mixing dispenser is adapted for mixing the flowable components as they are dispensed. A support structure is provided that facilitates kneading, as well as compression of the conduit to empty it. The support structure can be used as an applicator blade which is also reusable. Here again, the plural components have a tendency sometimes to flow in a reverse direction, i.e., causing incomplete emptying of the dispenser and/or requiring more compression strokes to obtain the total mixed contents.

SUMMARY OF THE INVENTION

It is an object of the invention to provide a mixing conduit by sealing together multiple layers of flexible sheet material, e.g., at seams located at peripheral edges and at points between the peripheral edges to form mixing obstructions, in a manner that reduces or eliminates the tendency for kneading or the like to produce a reverse flow. An inlet at one end of the conduit and an outlet at an opposite end are defined by the sheet material and the respective seams, along with a pair of overlapping flowable component storage compartments. A first set of compartments is formed by a plurality of spaced seams extending between side seams and joining together the top sheet and an interior sheet. A second set of compartments are similarly formed by seams joining the middle and bottom sheets, the second set of compartments overlapping the first set. Perforations or openings are formed in the interior sheet and communicate between different compartments. A flap of material is formed as a result of perforating the interior sheet. These flaps are attached to the edge of the interior sheet that define each perforated opening such that the flowpath passes through the respective compartments via the perforations in one direction, but is prevented from flowing back through the opening, in a reverse direction. The flaps open to forward flow and with their perforations form check valves which close the openings under pressure that would produce a reverse flow of the material. Preferably, an extensive three-dimensional one-way circuitous flowpath is formed to divide and recombine multiple layers of the flowable materials from the source of plural flowable components, until a desired mix is achieved, at which point the fluid mixture is dispensed from an outlet at a discharge end of the conduit. A number of successive compartments having perforations and flaps are passed. The flowable materials are prevented from flowing in a reverse direction by the flaps, which close to prevent local reversal of the flow at a given compartment or mixing stage.

BRIEF DESCRIPTION OF THE DRAWINGS

These and other features and advantages of the invention will be more fully understood from the following description of examples of the invention with reference to the illustrations appended hereto, wherein like numerals refer to like parts, and wherein.

DETAILED DESCRIPTION OF THE PREFERRED EMBODIMENT

Figure 1:
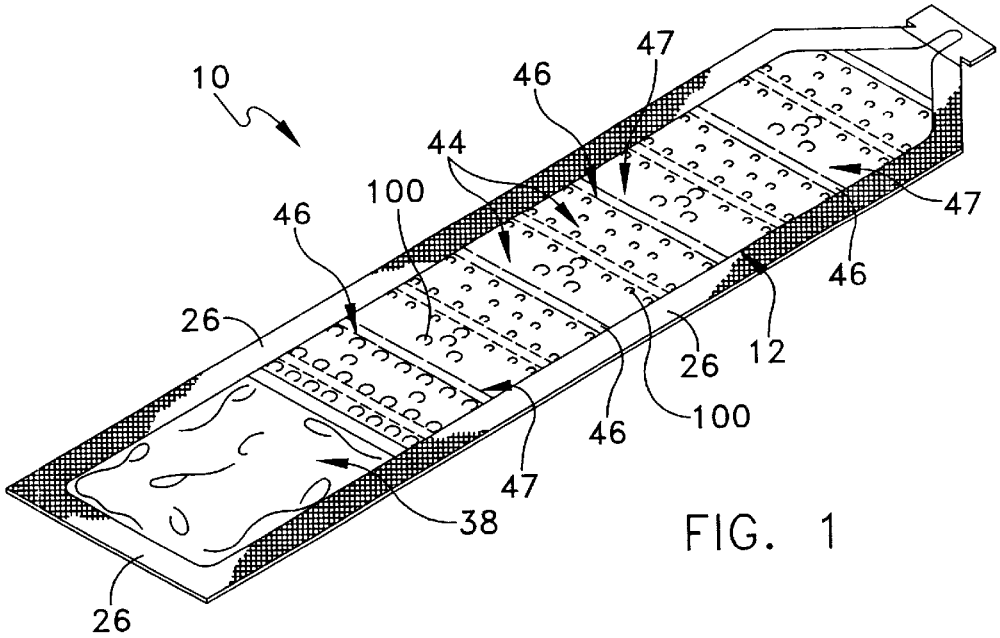
FIG. 1 is a perspective view of a mixing conduit formed in accordance with the invention.
Figure 2:
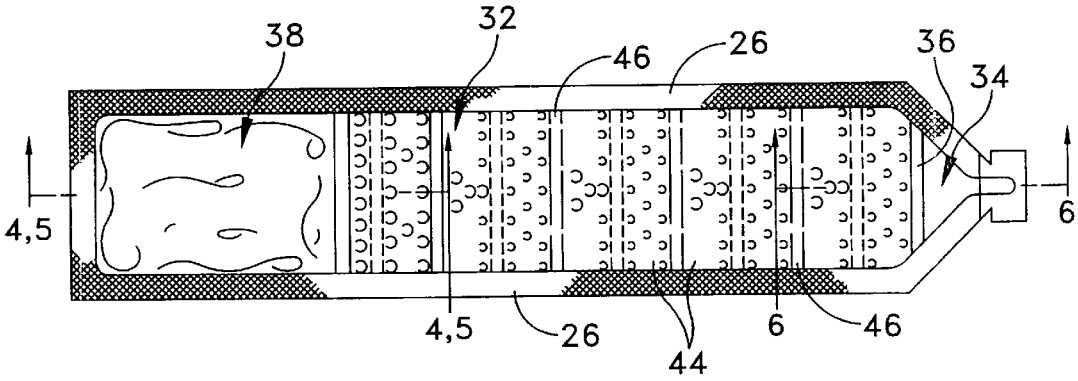
FIG. 2 is a top plan view of the mixing conduit shown in FIG. 1.
Figure 3:
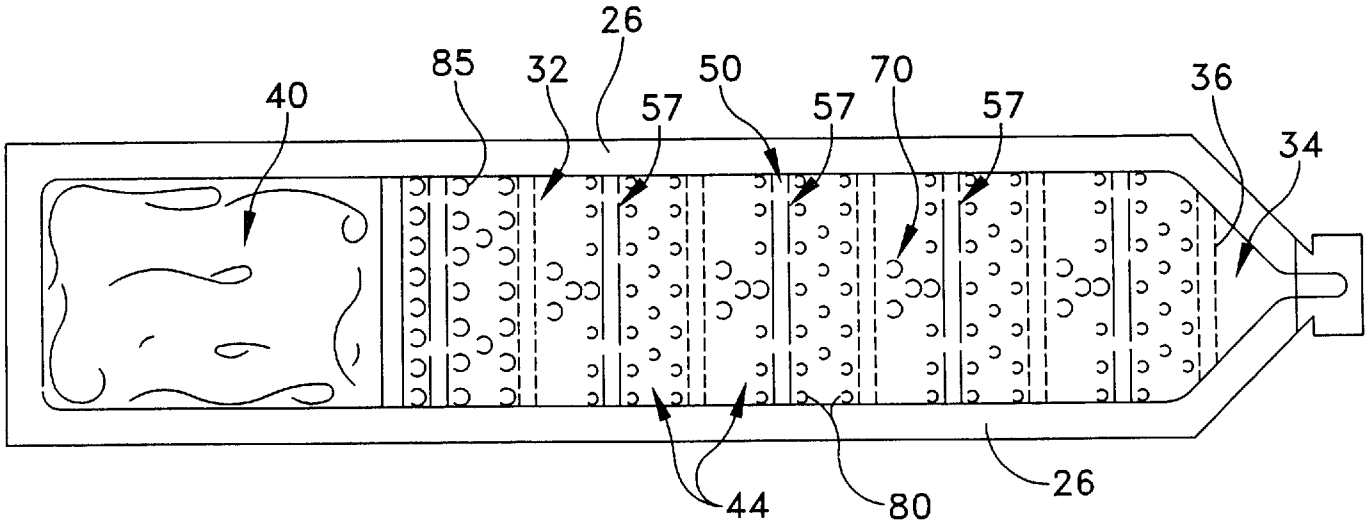
FIG. 3 is a bottom plan view of the mixing conduit shown in FIG. 1.
Figure 4:
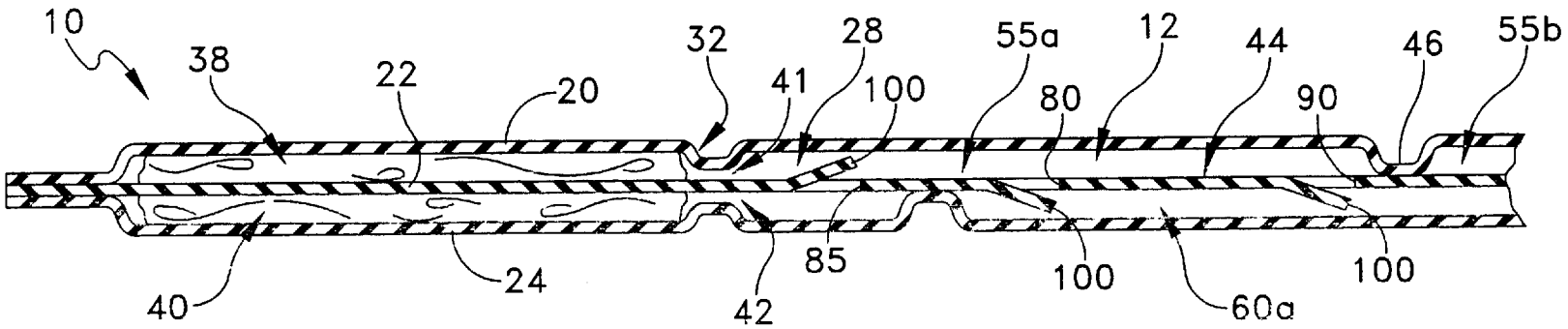
FIG. 4 is a cross-sectional view of the invention, as taken along line 4—4 of FIG. 2.

Referring to FIGS. 1 and 4, a mixing device 10 according to the invention comprises a mixing conduit 12 fabricated from three substantially coextensive sheets, namely a top sheet 20, an intermediate sheet 22 and a bottom sheet 24. Preferably sheets 20, 22, 24 are formed from a flexible material that is impermeable to the flowable components and the composition to be mixed. Sheets 20, 22, 24 are also non-reactive with the flowable components and the composition, e.g., thermoplastic elastomers such as polystyrene-dienes, polyurethanes, copolyester-ethers or other flexible elastomers may be used with good results. Preferred materials include Delrine type copolyethers of formaldehyde/ethyleneoxide. Sheets 20, 22, 24 are sealed together at seams 26 located at peripheral edges, for example by heat sealing, ultrasonic welding, adhesive or the like.

In the embodiment shown, the conduit is defined in part by opposite peripheral seams extending parallel to the general flowpath. The precise seam configurations are subject to variations. For example, the flexible material can be continuous along a side and folded over, as opposed to being seamed in the sense of having attached marginal edges. As another example, seams and obstructions can be provided in a tube configuration by internal points of attachment of the tube walls to one another or to one or more webs disposed within the tube. Thus, peripheral seams are discussed by way of example, and not by way of limitation, since the required structural arrangement is easily formed from web layers or the like.

As shown in FIG. 4, a flowpath 28 in mixing conduit 12 is defined between seams 26 and the facing sides of top and intermediate sheets 20 and 22, and bottom and intermediate sheets 24 and 22, respectively. The seams also define an inlet end 32 to flowpath 28, and a conduit outlet 34 at an outlet end 36. Between inlet end 32 and conduit outlet 34, the conduit defines a circuitous path that causes mixing due to eddies, turbulence and the separation and recombination of localized streams of material.

Adjacent to inlet end 32 are formed a pair of component storage compartments 38 and 40, which in this embodiment are overlaid. A lateral side-by-side arrangement is also possible, or the compartments can be arranged serially such that one empties into the next. In the embodiment shown, storage compartment 38 is formed between top and intermediate sheets 20 and 22 and storage compartment 40 is formed between bottom and intermediate sheets 22 and 24, respectively. Each storage compartment 38,40 is sealed at three edges by seams 26 and by first, laterally extending releasably adhered portions 41,42, respectively (FIG. 4), each of which form a rupturable seam. Each storage compartment 38,40 is adapted to hold a flowable component, and together maintain the two flowable components separate from one another. Releasably adhered portions 41,42 help to maintain each flowable component within its respective storage compartment until released into mixing conduit 12, as disclosed in further detail below.

A plurality of permeable obstructions 44 are formed by permanently adhered portions 46 of intermediate sheet 22 and top (exterior) sheet 20 and by permanently adhered portions 50 of intermediate sheet 22 and bottom (exterior) sheet 24. Each of the adhered portions 46, 50 extend laterally between seams 26 of mixing conduit 12 in substantially parallel-relation to releasably adhered portions 41, 42. In this way, intermediate sheet 22 and top sheet 20 define a plurality of discrete first compartments 55*a*–55*d*. While intermediate sheet 22 and bottom sheet 24 define a plurality of discrete second compartments 60*a*–60*d*, each overlapping a portion of an adjacent two compartments in a multilevel relationship (FIGS. 4, 5, 6, and 8). At least one by-pass channel 47,57 is formed through each adhered portion 46,50, respectively. There may be two, three or more by-pass channels. Adhered portions 46,50 thus form seams/obstructions 44 that are somewhat permeable, but not readily rupturable.

Openings 80, 85, and 90 are provided in intermediate sheet 22 to permit the flowable components to flow between each of the first compartments 55 and adjacent second compartments 60. Openings 80, 85, and 90 are preferably circular in shape and can have different diameters. More particularly, openings 80 preferably comprise a diameter of about 1 millimeter (mm), openings 85 comprise a diameter of about 2 mm and openings 90 comprise a diameter of about 3 mm. As a part of the process for forming openings 80, 85, and 90, a disc or flap 100 of the material forming intermediate sheet 22 is left attached to a portion of the edge that defines each opening when the opening is cut out. Each flap 100 is free to be pivoted outwardly on the connected portion, away intermediate sheet 22 and toward either top sheet 20 or bottom sheet 24, respectively. When flaps 100 are punched-out, the disc of material that forms each flap is deformed, and somewhat stretched, by the punching process. As a result, flaps 100 can nolonger fit into or, fully close-off, their respective openings 80,85,95. In this way, flaps 100 act as a plurality of check valves since the disc of material forming flap 100 will not easily go back through its respective opening.

In one embodiment, three rows of openings 85 are provided in substantially parallel adjacent relation to releasable adhered portion 41. This first three rows allow for flow from storage compartment 38 into an initial compartment 55*a*, thereby placing storage compartment 38 in fluid communication with first compartment 55*a*. Openings 80 and 90 are provided for flow from initial compartment 55*a* into second compartments 60*a*. Although, each of openings 80 is smaller in size than each of openings 90, there are a greater number of openings 80 than there are openings 90 in each grouping, i.e., the sets of openings have substantially equal total cross-sectional areas such that the flow will not be excessively inhibited at any one location. In addition, each grouping of openings 80 are spatially dispersed relative to each grouping of openings 90, thereby forcing the flow into a circuitous mixing path.

Figure 5:
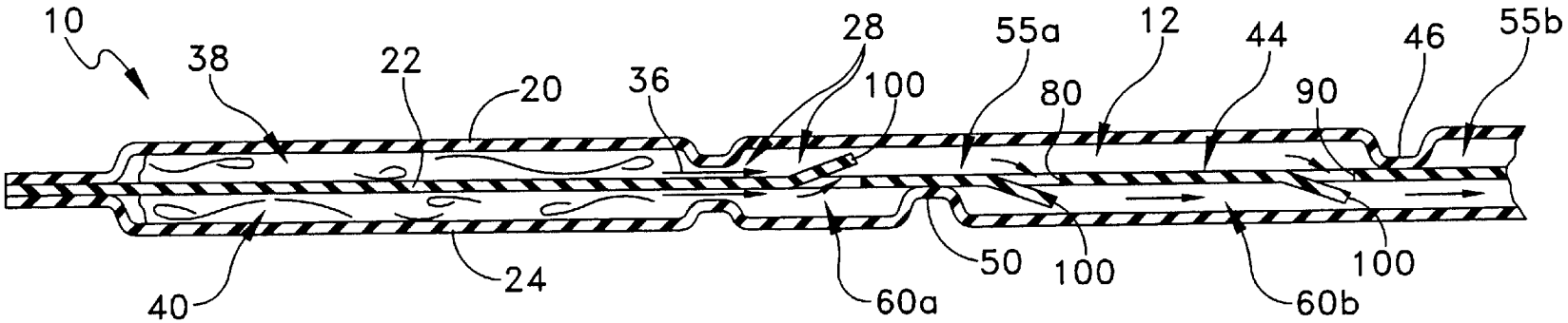
FIG. 5 is a cross-sectional view similar to FIG. 4 as taken along line 5—5 of FIG. 2, schematically representing the flow of material through the mixing conduit.
Figure 6:
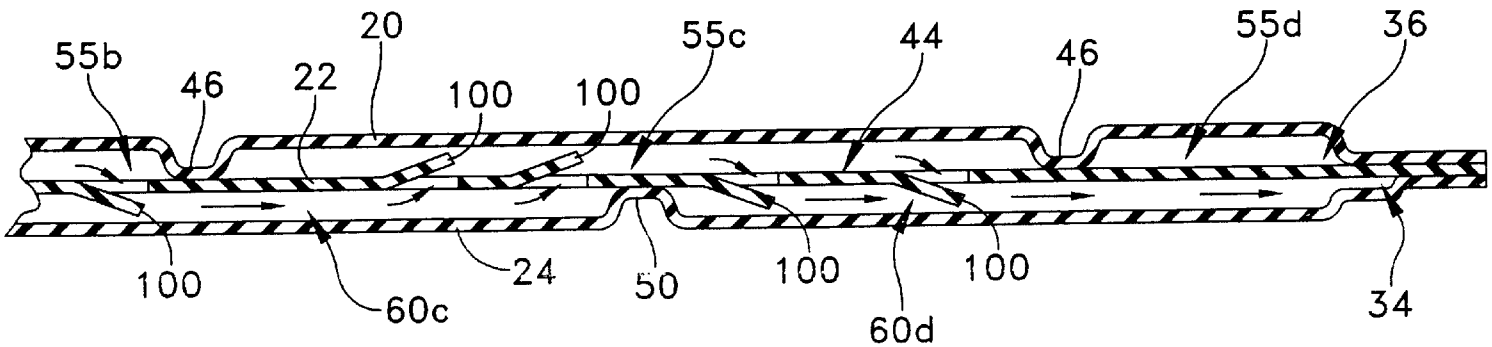
FIG. 6 is a cross-sectional view of the invention, as taken along line 6—6 of FIG. 2.
Figure 7:
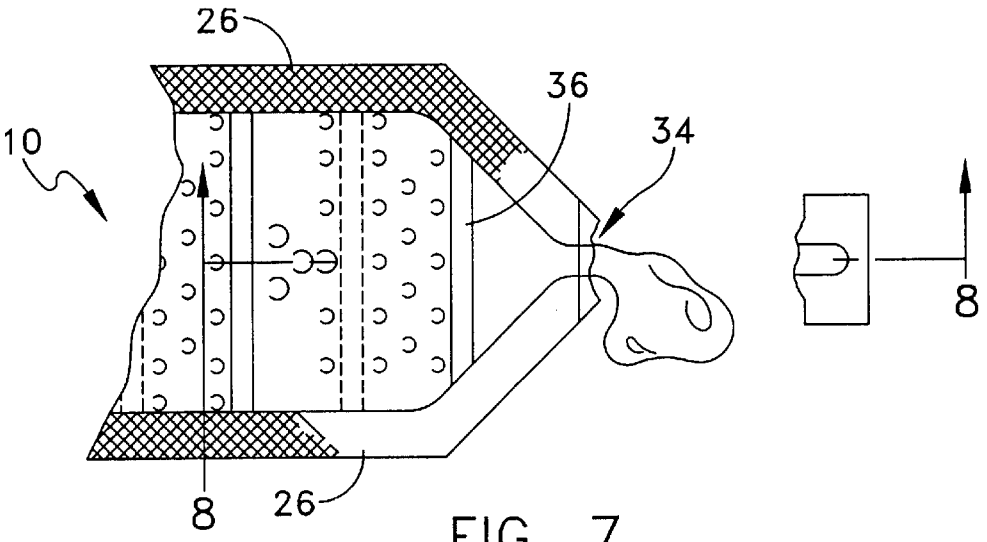
FIG. 7 is a top plan view of the dispensing end of the wiring conduit.
Figure 8:
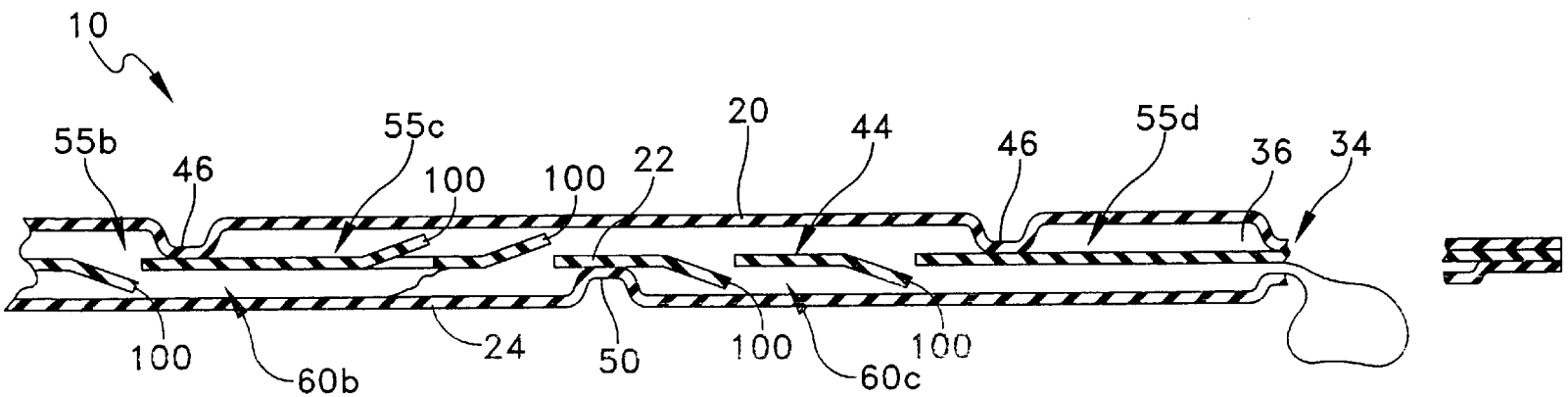
FIG. 8 is a cross-sectional view of the invention, as taken along line 8—8 of FIG. 7.

When the mixing device 10 is assembled, the flowable components can flow as indicated by arrows in FIGS. 5 and 6, through the various openings 80, 85, 90, 47, 57 and compartments 55*a*–*d*, 60*a*–*d*. More particularly, when squeezing pressure or the like is exerted on device 10, the components initially flow through the sets of openings 85 into compartment 55*a*. Then, the components flow through openings 80 and 90 into compartment 60*a,* and continue downstream through openings 80 and 90 into compartment 60*b,* through openings 90 into compartment 60*b,* through openings 80 into compartment 60, through openings 90 into compartment 60*c,* through openings 80, being mixed by flow around the successive obstructions provided, i.e., continuously dividing and recombining the material stream. Flaps 100 initially open forwardly to allow flow. Flaps 100 close back against the panel from which they were cut to prevent the flowable components from being forced back toward their respective storage compartments 38,40. The flaps reduce or prevent premature mixing or contamination of the components during mixing. In this way, the flowable components flow in one direction only, i.e., from inlet 32 to outlet end 36. The mixed flowable material finally is dispensed through outlet 34 (FIG. 8).

Because openings 80,85,90 are not always situated precisely and accurately at the end of a compartment, i.e., adjacent to seams 46, 50, a small build-up of mixture can occur at the blind end of each compartment. This build-up of mixture may be enhanced when openings 80,85,90 have flaps 100 associated with them, since if the flaps are very close to seams 46,50, they tend to close-off the whole perforation. By-pass channels 47,57 alleviate this build-up of mixture at the blind end of each compartment by allowing this material to be shunted past each seam 46,50 to the next compartment, where it rejoins the bulk of the flowing material. Although this shunting effect allows a small quantity of material to bypass the mixing action created by the obstructions 44, it nevertheless results in a thoroughly uniform dispersion of product by the time that the bulk of the flowing material reaches conduit outlet 34. Thus by-pass channels 47,57 allow for a more complete recovery of mixed product and a decrease in the pressure drop or back pressure exprerienced in pushing the mixture through the package.

Forcing the flow through the tortuous path hereinabove described will thoroughly mix low viscosity components by turbulent mixing. The flow can be driven in any convenient manner, such as by compressing storage compartments 38,40 manually, by a piston driven or pneumatic applicator arrangement, and/or by compression of the flexible conduit with a pinch roller means or the like (not shown).

Whereas particular embodiments of the invention have been described herein as examples, it will be appreciated that variations of the details may be made without departing from the invention. Therefore, reference should be made to the appended claims rather than to the foregoing discussion of preferred examples, in order to assess the scope of the invention in which exclusive rights are claimed.

What is claimed is:

1. A static mixing device for mixing at least two flowable components of a composition comprising:

a disposable mixing conduit having first and second facing exterior sheets, and a third sheet positioned between said exterior sheets so as to form an interior sheet along at least part of the first and second exterior sheets, said first, second and third sheets being sealed together at seams defining two peripheral side seams and at least one peripheral end seam of a flowpath, said mixing conduit defining an outlet at an edge spaced away from said peripheral end seam;

a first storage compartment formed by a seam extending between said two peripheral side seams and joining together said first sheet and said interior sheet;

a second storage compartment formed by a seam extending between said two peripheral side seams and joining said interior sheet and said second sheet;

a first set of mixing compartments formed by a plurality of spaced seams extending between said two peripheral side seams and joining together said first sheet and said interior sheet and disposed in fluid communication with said first storage compartment; and, a second set of mixing compartments formed by a plurality of spaced seams extending between said two peripheral side seams and joining said interior sheet and said second sheet and disposed in fluid communication with said second storage compartment;

said interior sheet having a plurality of openings which communicate between corresponding first and second sets of mixing compartments, each of said openings including a flap, each of said flaps being integral with an edge portion adjacent to a corresponding one of the openings and operable such that the flow of said at least two flowable components through the respective compartments in one direction displaces said flaps away from said openings, and is prevented from flowing back through said openings in a reverse direction by said flaps.

2. The static mixing device of claim 1, wherein said first and second sets of compartments define a circuitous flowpath for providing turbulent mixing of the at least two flowable components.

3. The static mixing device of claim 1, wherein said first and said second sets of compartments are disposed in overlapping-relation to one another.

4. The static mixing device of claim 1, wherein the flaps are substantially circular.

5. The static mixing device of claim 1, wherein the first and second storage compartments are substantially coextensive with one another between the interior sheet and said first and second exterior sheets, respectively.

6. The static mixing device of claim 5, wherein the first and second sets of mixing compartments are staggered along the flowpath such that the material flows serially into a first said mixing compartment and from said first mixing compartment into a second said mixing compartment.

7. The static mixing device of claim 6, wherein the openings between the first and second sets of mixing compartments are of different diameters for passage in one direction from a first said mixing compartment to a second said mixing compartment than in an opposite directions, whereby the material is successively subdivided at smaller diameter openings and recombined at larger diameter openings.

8. The static mixing device of claim 6, wherein a plurality of obstructions are formed by adhered portions of said third sheet and portions of at least one of the first and second exterior sheets, each of said obstructions extending laterally between said two peripheral side seams.

9. The static mixing device of claim 8 wherein said plurality of obstructions define at least one by-pass channel extending between said first and second storage compartments.

10. The static mixing device of claim 1, wherein the first and second sets of mixing compartments are staggered along the flowpath such that the material flows serially into a first said mixing compartment and from said first mixing compartment into a second said mixing compartment.

11. A static mixing device for mixing at least two flowable components of a composition comprising:

a disposable mixing conduit having first and second facing exterior sheets, and a third sheet positioned between said exterior sheets so as to form an interior sheet along at least part of the first and second exterior sheets, said first, second and third sheets being sealed together at two side edges defining two peripheral side seams and at least one peripheral end edge of a flowpath, said mixing conduit defining an outlet at an edge spaced away from said peripheral end edge;

a first storage compartment formed by a seam extending between said two peripheral side seams and joining together said first sheet and said interior sheet;

a second storage compartment formed by a seam extending between said two peripheral side seams and joining said interior sheet and said second sheet;

a first set of mixing compartments formed by a plurality of spaced seams extending between said two peripheral side seams and joining together said first sheet and said interior sheet and disposed in fluid communication with said first storage compartment; and, a second set of mixing compartments formed by a plurality of spaced seams extending between said two peripheral side seams and joining said interior sheet and said second sheet and disposed in fluid communication with said second storage compartment wherein said plurality of spaced seams define at least one by-pass channel extending between said first and second sets of mixing compartments;

said interior sheet having a plurality of openings which communicate between corresponding first and second sets of mixing compartments, each of said openings including a flap, each of said flaps being integral with an edge portion adjacent to a corresponding one of the openings and operable such that the flow of said at least two flowable components through the respective compartments in one direction displaces said flaps away from said openings, and is prevented from flowing back through said openings in a reverse direction by said flaps.

* * * * *